United States Patent [19]

Leopold

[11] Patent Number: 5,028,053

[45] Date of Patent: Jul. 2, 1991

[54] ERRATIC BOUNCING BALL

[76] Inventor: Michael Leopold, 70 W. 71 St., Ste. 3D, New York, N.Y. 10023

[21] Appl. No.: 583,039

[22] Filed: Sep. 14, 1990

[51] Int. Cl.[5] ..... A63B 41/08; A63B 43/00; A63B 67/00

[52] U.S. Cl. ..... 273/411; 273/58 K

[58] Field of Search ..... 273/411, 58 R, 58 A, 273/58 B, 58 BA, 58 K

[56] References Cited

U.S. PATENT DOCUMENTS

| | | | |
|---|---|---|---|
| 744,718 | 11/1903 | Cassidy | 273/58 K X |
| 2,078,382 | 4/1937 | Hanshaw | 273/58 K X |
| 3,948,521 | 4/1976 | Warren | 273/411 X |

*Primary Examiner*—William H. Grieb
*Attorney, Agent, or Firm*—Louis Weinstein

[57] ABSTRACT

A ball capable of providing an erratic, as well as a normal, bounce comprised of a hollow spherical member and, preferably, twenty-two integral hemispheric projections arranged in a predetermined pattern about the periphery of the spherical-shaped member. The projections are of uniform diameter which is a predetermined relationship to the diameter of the spherical-shaped member to achieve a desirable ergonomic effect. The cumulative volume of the hemispheric projections is substantially equal to one-half the volume of the spherical member and the radius of the spherical member is preferably of the order of 2.8 times the diameter of the projections. The game ball may be provided in the form of a kit including a cord having predetermined colored markers for creating the playing court which has a likeness of an international "PEACE" symbol. The projections may be provided with a similar "PEACE" symbol.

20 Claims, 10 Drawing Sheets

ERRATIC BOUNCING BALL

FIELD OF THE INVENTION

The present invention relates to a resilient ball, and more particularly, to a novel resilient ball exhibiting an erratic bouncing behavior due its novel geometric design.

BACKGROUND OF THE INVENTION

It is an objective of the present invention to provide a novel game utilizing a game ball which exhibits an erratic bouncing behavior.

Most game balls are generally spherical in nature and have a substantially smooth surface which tends to yield an expectant bounce or rebounding of the game ball from a playing surface or surfaces, presupposing that said surface or surfaces are substantially smooth and flat. It is an objective of the present invention to provide an added dimension to the play of the game by providing a game ball which can exhibit rebounding from a surface in a manner which can be normal or erratic to thereby add a new and exciting dimension to the game, due to the fact that the actual rebounding nature of the ball cannot be determined beforehand.

BRIEF DESCRIPTION OF THE INVENTION

The game in which the game ball of the present invention is utilized is designed in such a manner as to provide a unique playing surface which, when combined with the unique game ball, provides an exciting and challenging game which serves to develop and sharpen the skills of the players and increasing the level of interest in the game.

The ball has a unique design which is comprised of a generally spherical-shaped, hollow resilient member of a diameter enabling the game ball to be easily held by the average hand. The game ball further includes a plurality of integral, generally hemispheric-shaped projections arranged in a predetermined geometric pattern about the nominal surface of the game ball in order to provide both regular and irregular rebounding of the game ball upon a substantially planar surface which further adds to the excitement and enjoyment of the use of the game ball in the play of the game.

The game ball may also be provided as one constituent of a kit including a simple and yet novel means for creating the game surface through the use of only a single length of rope and a chalk or crayon or other like marker for use on rigid surfaces or a stick or other relatively sharp pointed instrument for creating the playing field upon a surface which is easily scored, such as, for example, a sandy beach. The playing field or court substantially resembles the internationally recognized "PEACE" symbol and the rope is arranged to be knotted to form a loop at each end so that colored markers arranged at predetermined distances inwardly from each end of the rope are arranged at the middle of each loop. A playing court is created by marking a point on the playing surface identified as the center point. A colored marker in one of the loops is held at the center point, for example, by the finger of one player while a second player places a marking instrument (chalk, crayon, stick, etc.) through the opposite loop so that it is aligned with the colored marker in the remaining loop. The second player pulls the rope taut and, moving in a circle about the center point creates the circular perimeter of the playing court. The rope is then pulled taut and a line is drawn from the point marking the center of the court to any location along the perimeter, thus defining a radius. This radius line may be drawn by holding the rope taut and moving the marking instrument along the rope, using the rope as a guide. A similar radius line is drawn co-linear with the first radius line to create a diameter, using the same technique described hereinabove.

A third colored marker provided along the rope a spaced distance inward from ends of the rope is utilized to mark off two points along the circular perimeter which points are equispaced from one end of the diameter line which intersects the circular perimeter. These two points are then used to create a radial line between each of said points and the center mark whereupon a playing court which resembles the "PEACE" symbol is created. The playing court has four distinct regions. One pair of regions are mirror images of one another as is a second pair of regions. The regions of smaller surface area are utilized for service areas, the object being to hit the ball from a point outside of the perimeter of the playing area over the centerline (diameter) and into the service area assigned to the opposing team. Once the game ball has been properly served, then the entire playing surface, including both service areas, may be utilized with the proviso that each team must hit the ball over the centerline and into the playing area assigned to the opposing team.

The unique game ball provides an additional dimension of excitement and challenge to the players of both teams since a player of the team receiving the game ball, in addition to it being uncertain about the location to which the game ball will be directed by the player of the opposing team hitting the ball, will also be uncertain about the angle (i.e. normal or erratic) at which the ball will rebound from the playing surface, due to the unique configuration of the game ball.

OBJECTS OF THE INVENTION

It is, therefore, one object of the present invention to provide a novel game ball which, due to its unique design, which comprises a generally spherical-shaped resilient member, provided with a plurality of generally hemispherical-shaped projections, further has said projections arranged in such a manner as to be capable of causing the game ball to rebound from a substantially planar surface in both a normal and an erratic manner, depending upon the orientation of the game ball surface which strikes the playing surface, thus adding a unique and exciting dimension to use of the ball.

Still another object of the present invention is to provide a novel game including a game ball and playing surface and further including simple means for creating the game ball playing court in a simple and efficient manner.

BRIEF DESCRIPTION OF THE FIGURES

The above, as well as other objects of the present invention, will become apparent when reading the accompanying description and drawings in which.

DETAILED DESCRIPTION OF THE INVENTION AND PREFERRED EMBODIMENTS THEREOF

Exterior Qualities of the Ball

Figure 1:
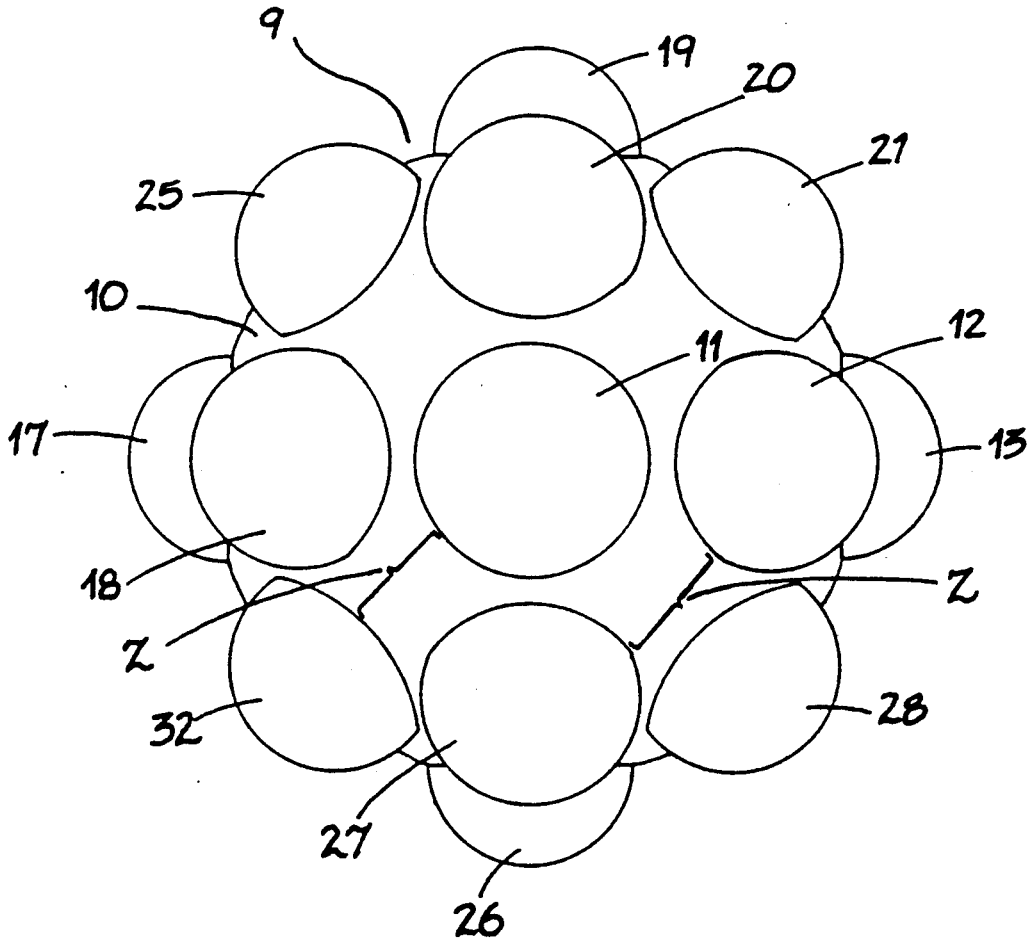
FIG. 1 shows a front elevation of a game ball designed in accordance with the principles of the present invention.
Figure 2:
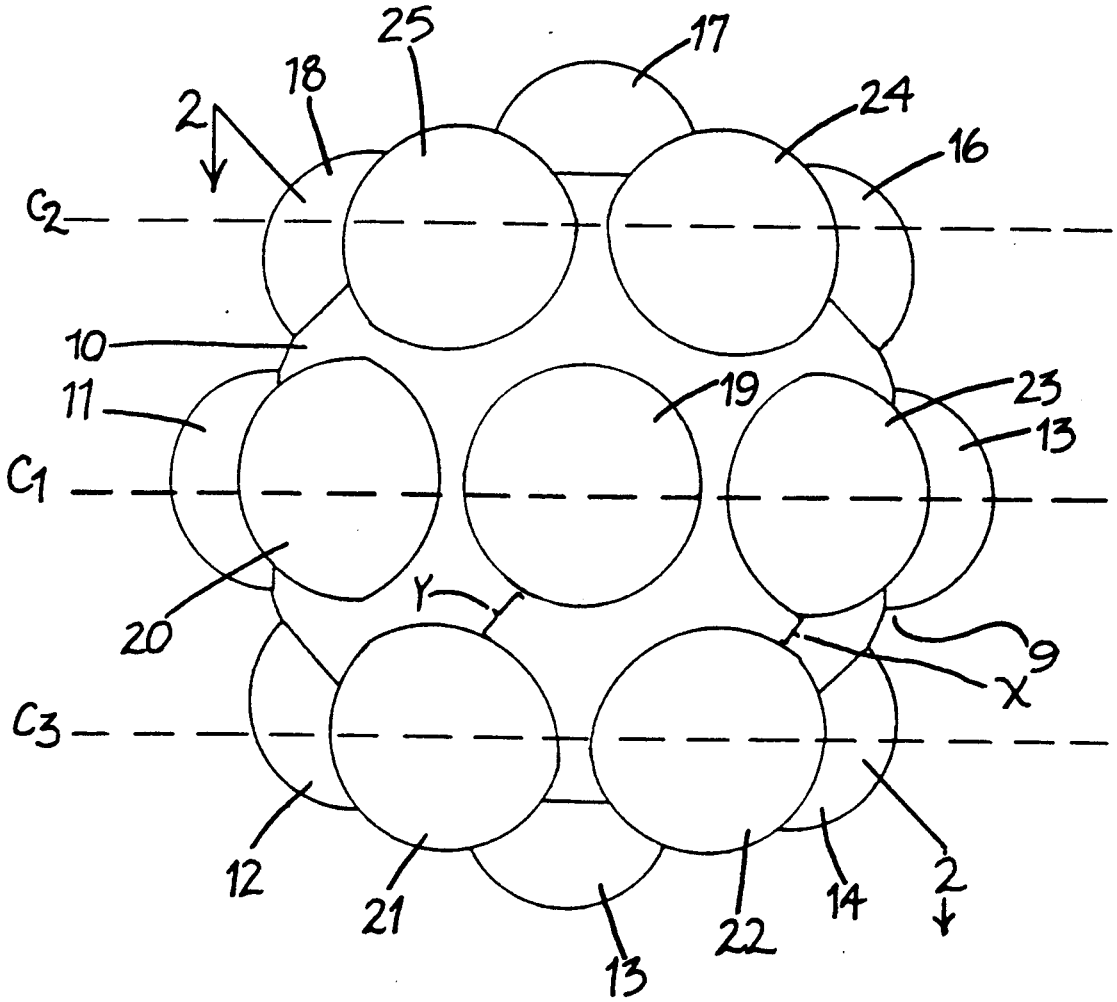
FIG. 2 shows a perspective view of another portion of the game ball of FIG. 1.
Figure 2A:
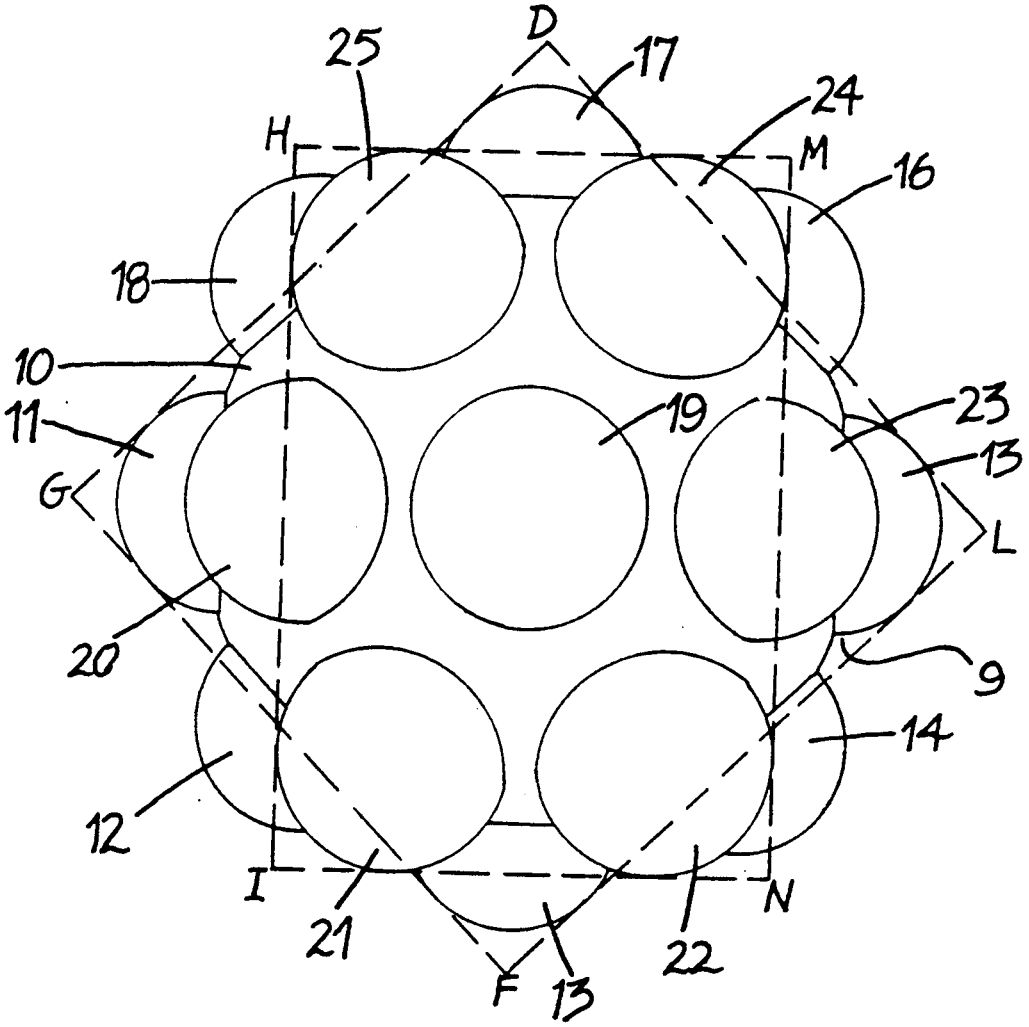
FIG. 2*a* shows a perspective view of the game ball of FIG. 2 and superimposed rectangles which are useful in explaining the geometric arrangement of the hemispheric projections arranged on the ball.

FIGS. 1, 2 and 2*a* show a game ball 9 designed to embody the symmetrical, ergonomic and erratic capabilities incorporated in the game ball. The game ball 9 shown in FIG. 1 is comprised of a generally spherical-shaped ball 10 having a nominal diameter which is of a size rendering the ball capable of being held within the hand of the average person. The ball is preferably formed of a resilient, rubber or rubber-like material having a hollow interior and provided with a plurality of hemispheric-shaped projections, for example, projections 11–32 shown in FIGS. 1 and 2.

Figure 1A:
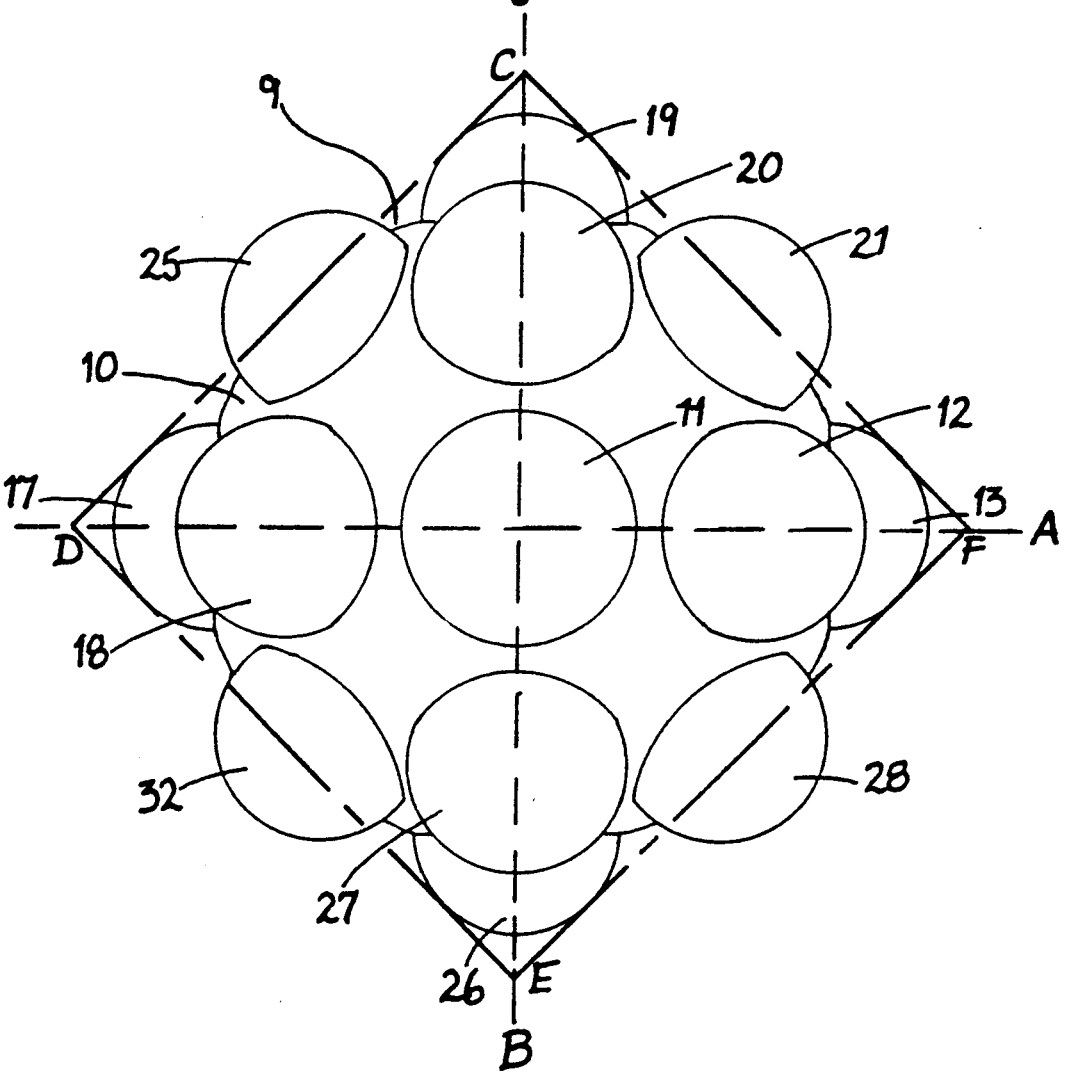
FIGS. 1*a* and 1*b* show perspective views of the game ball of FIG. 1 together with rectangles superimposed upon these views to facilitate an understanding of the geometric arrangement of the hemispheric projections arranged on the periphery of the ball.
Figure 1B:
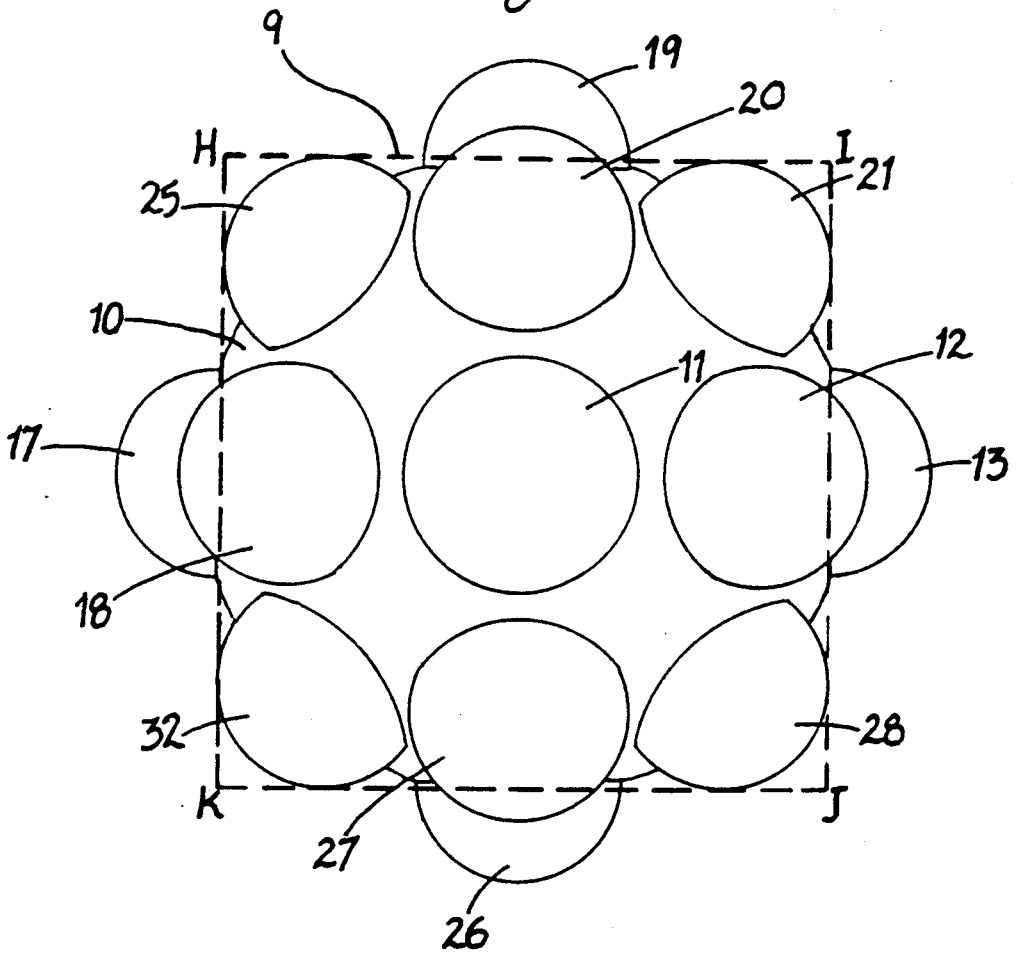

FIGS. 1*a*, 1*b* and 2*a* are useful in demonstrating the symmetry of ball 9. FIG. 1*a* incorporates a perfect square CDEF which is formed by connecting the dome-shaped projections at the end of perpendicular lines A and B. The square is formed by connecting points C and D such that the line therebetween is tangent to the surfaces of projections 17 and 19 and to the nominal surface of the main spherical-shaped member or ball 10. Lines DE, EF and CF are formed in a similar manner thereby creating a perfect square.

A perfect square having the vertices H, I, J, K as shown in FIG. 1*b* is formed by connecting the projections of the ends of lines H, J, and I, K. Points H and I are connected by a line which is tangent to the surfaces of projections 21 and 28 and the base of projection 13. Lines IJ, JK and HK are formed in a similar manner.

Noting FIG. 2, for example, eight projections including projections 11, 20, 19, 23 and 15 lie at equispaced intervals along an equatorial circle (dotted line C1); a second group of six projections including projections 18, 25, 24 and 16 lie at equispaced intervals along a circle C2 which lies in a plane parallel to the plane in which circle C1 lies; a third group of six projections including projections 12, 21, 22 and 14 lie at equispaced intervals along a circle C3 which lies in a plane parallel to the plane of circle C2; two projections 17 and 13 lie upon the surface of ball 10 and have their centers aligned coaxial with a diameter of ball 10 which is perpendicular to the plane of equatorial circle C1 (for a total of twenty-two projections). The circle C1 lies in a plane which is equidistant from the planes of circles C2 and C3.

The perfect square GDLF is formed in FIG. 2*a* by connecting the tangential points on the surfaces of projections 11, 13, 15, and 17 as well as the nominal surface of the main ball 10. The dome-shaped projections 11, 13, 15 and 17 of FIG. 2*a* are located on the equatorial line AD shown in FIG. 1*a*. Rectangle HMNI is formed by connecting tangential points on projections 25, 24, 22 and 21.

Ball 9 may be said to have two distinct sections: central ball 10 and the twenty-two integral dome-shaped projections 11–32 Projections 11 and 15 are hereinafter referred to as "radial projections" because they are found at the intersection of lines C–E and D–F. Projections 13, 17, 19 and 26 are hereinafter referred to as "polar projections" which are located at the "poles". These terms are utilized due to the unique shape assumed by adjacent projections.

There is a total of sixty-four spaces between adjacent projections. Thirty-two spaces are identified by a distance X (see FIG. 2), sixteen spaces are identified by a distance Y (see FIG. 2), and sixteen spaces are identified by a distance Z (see FIG. 1). The distance Y is twice as great as distance X. The spaces between projections having a distance Y are found only within the rectangle HMNI which cuts straight through ball 9 in a three-dimensional manner, as shown best in FIG. 2*a*. Some of the projections (see projection 11) are surrounded by eight projections (18, 32, 27, 28, 12, 21, 20 and 25) as shown in FIG. 1. Other projections (see projection 19) are surrounded by six projections (see projections 25, 20, 21, 22, 23 and 24) as shown in FIG. 2.

Referring to FIG. 1*a*, the spaces of a length Y are located around the projections at polar points C, D, E and F. Four of the six projections that surround each of these polar projections are spaced from the polar projections by the distance Y. Referring to FIG. 1, the projections spaced by a distance Z from projection 11 are arranged on both sides of the intersection of lines C–E and D–F. There are eight such spaces of the distance Z on either side of ball 9, for a total of sixteen. The distance between projections 11 and 32 is the distance Z as is the distance between projections 27 and 12. Although these distances are different, a Z space is defined as any space between projections that is greater than the distance space X or Y.

Figure 2B:
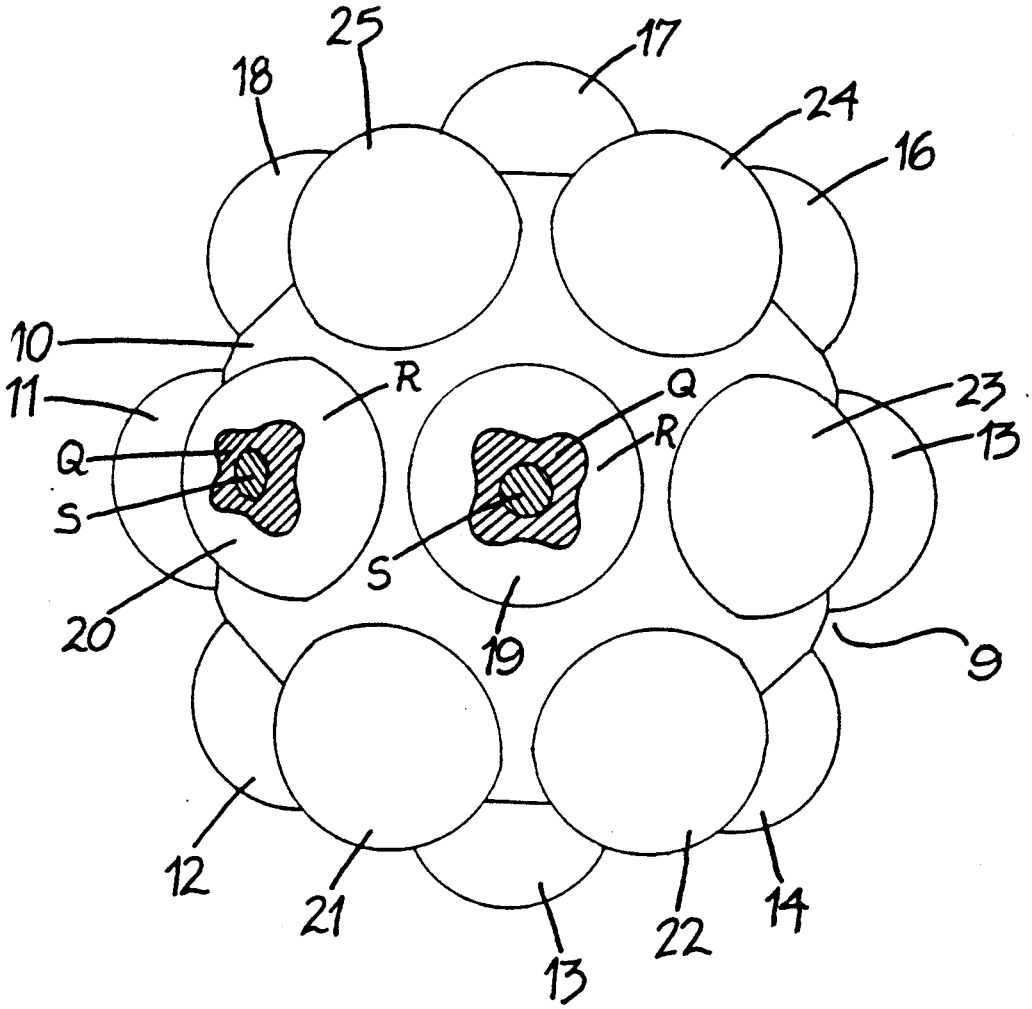
FIG. 2*b* shows a perspective view of a portion of the game ball of FIG. 2 which depicts the "area of erraticism" and is useful in describing same.

As can clearly be understood from FIGS. 1–2*a*, ball 9 is capable of exhibiting an erratic bounce or rebound after striking a planar surface. Based on the geometric design, approximately twenty-five percent of the bounces will be erratic. In addition, there is a variation within this percentage that ranges from slightly erratic to mildly erratic. Due to the unique geometric arrangement, the ball will never bounce crazily or out of control. This unique phenomenon results from the size and close proximity of the projections 11–32. Noting FIG. 2*b*, the projection 11 is shown as being divided into three surface areas. The center area S is considered to be a non-erratic area. The convex-shaped surface area S reacts to a flat surface in the same way as central ball 10 would if it were not covered with projections. However, when ball 9 hits a flat surface with some significant force, the projection 11 will flatten out slightly and yield a true, predictable bounce. The second surface area Q surrounding area S is referred to as the "area of erraticism". If any portion of the surface Q strikes the game surface, it will react to a flat game surface in an erratic manner.

If any portion of surface Q of projection 11 engages the playing surface, the further such point of impact lies from surface area S, the more erratic will be the rebound angle until reaching the boundary line between the surface areas Q and R. The surface area R on projection 11 will never engage a flat surface due to the fact that adjacent projections 18 and 20, for example, either alone or together, will react to the flat surface in cooperation with projection 11. In a similar manner, other projections adjacent to projection 11 cooperate with projection 11 to prevent the surface area R of projection 11 from engaging the playing surface. In fact, the surface R of any of the other projections will not engage a flat surface due to the close proximity of adjacent projections which cooperate to prevent such an impact.

If two projections, such as, for example, projections 11 and 18, simultaneously strike the playing surface, the "area of erraticism" is diminished on both projections to the upper and lower portions of area Q, and any rebound that occurs when projections 11 and 18 strike the playing surface will become more erratic as the angle of the bounce approaches the area R on each of the projections which strike the playing surface. However, a flat playing surface will not make contact with area R on the projections since projection 20, for example, cooperates with projections 11 and 18 to prevent surface portions R on these projections from engaging a flat playing surface, with the result that ball 9 will bounce in a predictable manner due to the engagement of three cooperating projections with the playing surface. A game ball having three projections, such as, for example, projections 11, 18 and 20 striking the playing surface will not experience an erratic bounce due to the fact that the force of the impact in the areas Q of each of the projections 11, 18 and 20 strike the flat playing surface. This result is determined from the knowledge that, at rest, ball 9 will come to rest on a planar surface with three of its projections engaging the planar surface, never more or less.

Although it is possible for four projections to strike a flat playing surface simultaneously this will only occur when the game ball strikes the playing surface with sufficient force. These occurrences are rare and will further only occur when one of the four projections striking the playing surface includes radial projection 11 or 15. Thus it can be seen that the areas Q and S are the active areas of projections 11–32 which will most likely strike a flat playing surface. No other areas of ball 9 will come into contact with such a playing surface. The surface areas R of all projections are important in maintaining the ergonomic appeal of ball 9 since these areas are the areas which feel most comfortable for a player to grasp or strike.

Considering FIGS. 1 and 2, it can be demonstrated that the configuration of the projections is the most natural arrangement on central ball 10 of the size shown, the diameter preferably being on the order of 3.5 inches. A ball of this size has been found to be comfortable to grasp and has significant ergonomic appeal. The key to maintaining the ergonomic appeal and the slightly erratic bounce of ball 9 is a relationship of central ball 10 to the dome-shaped projections 11–32. The volume Of central ball 10 is forty-four times the volume of each projection. There are twenty-two projections, each having a diameter preferably of the order of 1.25 inches, said projections being spaced in a predetermined geometric fashion about the surface of central ball 10. It therefore follows that the volume of central ball 10 is twice that of the total volume of the twenty-two projections. This is not a random statistic but is the linchpin in achieving the unique qualities of ball 9. Changing one or more of the three variables, central ball size, projection size and number of projections, will significantly alter the ergonomics and erratic bounce of ball 9. As an example, the effect on ball 9 of a change of just one of these variables will now be considered.

For example, assuming central ball 10 is made twice its present size, i.e. a diameter of seven inches, the relationship of the volume of central ball 10 to the combined volume of the twenty-two projections is increased eight-fold. Due to the fact that the projections will be spaced by greater distances from one another ball 9 will be caused to bounce more erratically due to the fact that the "area of erraticism" Q of the smaller diameter ball will now expand into the area R. In addition, the spreading out of the projections over the surface area of a larger diameter central ball serves to decrease the ergonomic appeal of ball 9 due to the fact that the ball 9 does not conform as well to the holder's hand. Ball 9 thus becomes harder to grasp and is significantly less appealing as a game ball. It can further be seen that by changing one or more of the three abovementioned variables the volume ratio is effected by differing degrees which further leads to changes in both the ergonomic appeal and the erratic quality of the ball.

Figure 3:
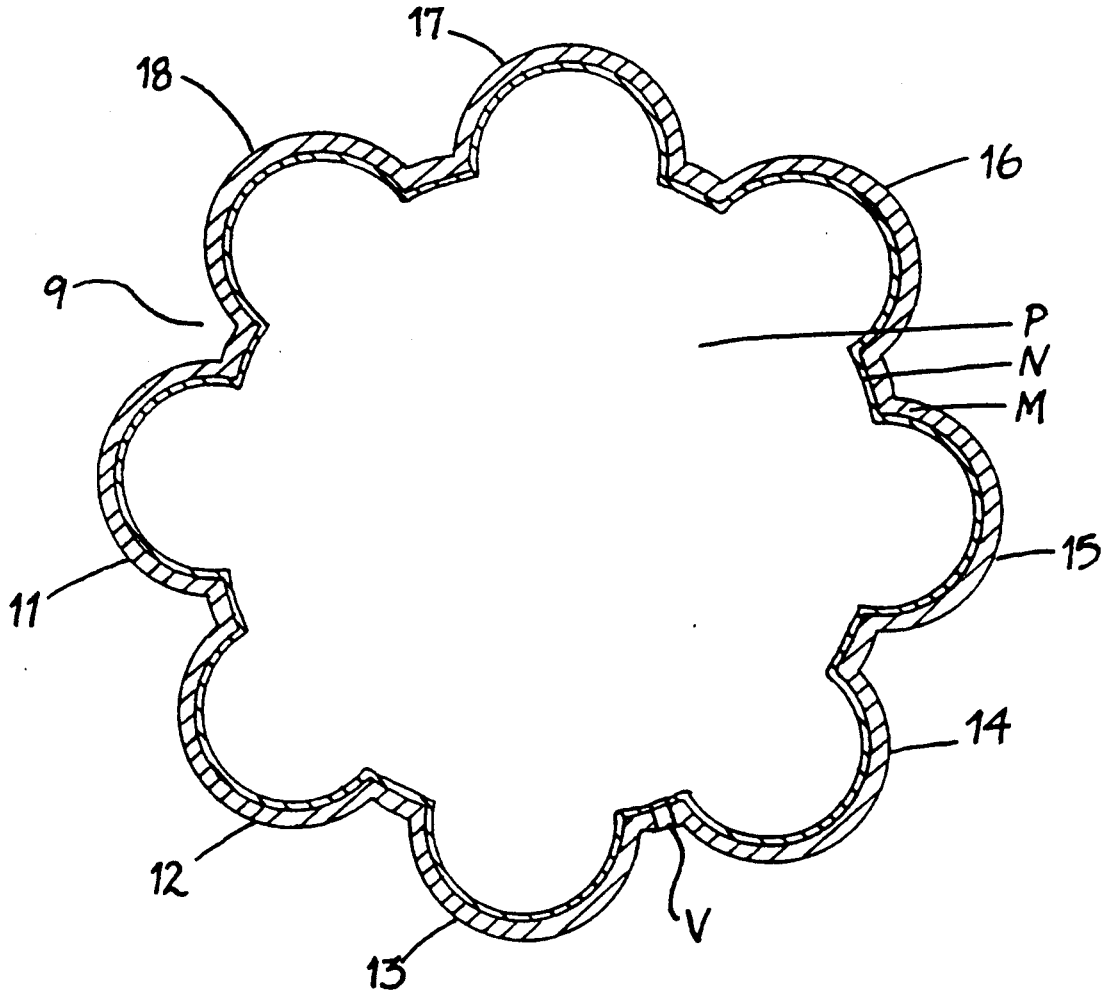
FIG. 3 is a sectional view of the game ball taken along the lines 2—2 of FIG. 2.
Figure 4:
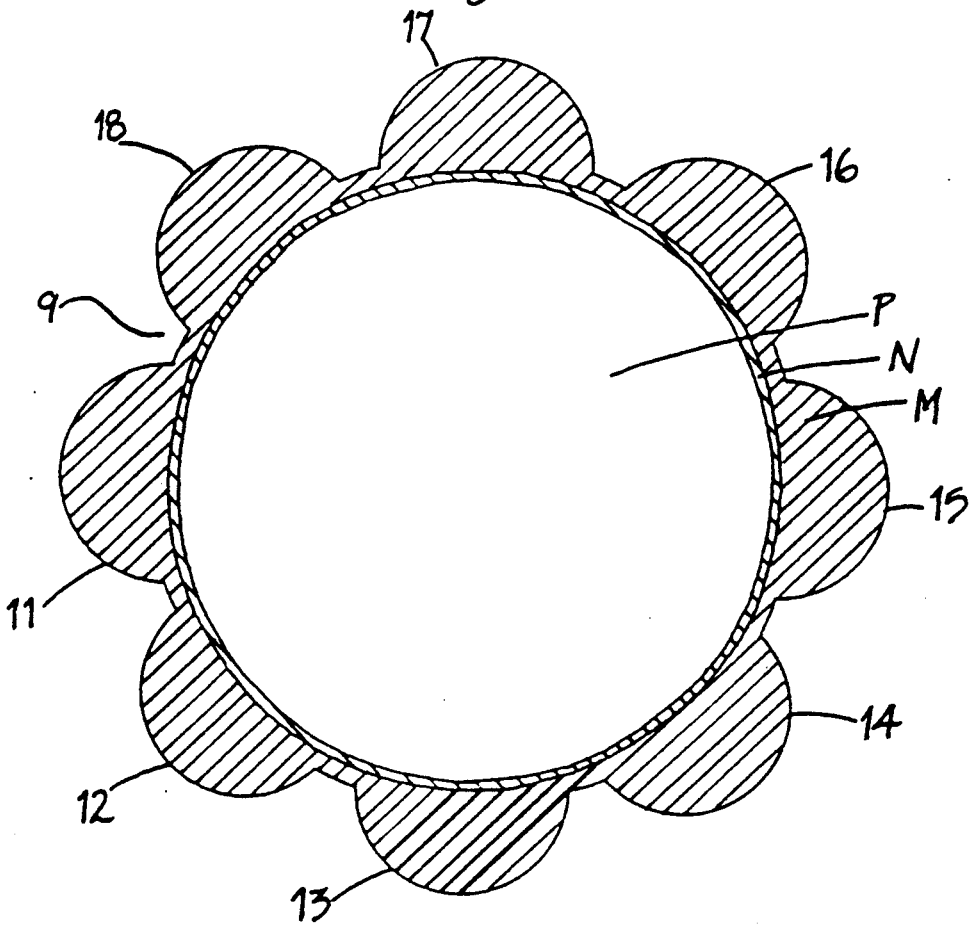
FIG. 4 shows a sectional view of the game ball of FIG. 2 looking in the direction of lines 2—2 of FIG. 2, the arrangement of FIG. 4 being an alternate embodiment of that shown in FIG. 3.

FIGS. 3 and 4 show two alternative arrangements for the ball structure comprised of an outer casing M, an inner rubber bladder N, and an air-filled interior P. One preferred arrangement is shown in FIG. 3 in which the outer casing M is formed of a durable, resilient, rubbery material which may be similar to that employed in a rubber or rubber-like basketball. The thickness of outer casing M is preferably in the range from 1/16 to ⅛ inches. Bladder N conforms to the outer casing. A valve V of conventional structure is provided to initially inflate and occasionally refill the game ball with air, when necessary. Any suitable valve structure may be employed, such as, for example, the valve structure employed in indoor and outdoor type game balls such as basketballs, soccer balls, footballs and the like. The positioning of valve V is chosen so as not to have any effect upon the erratic quality of ball 9.

FIG. 4 shows an alternative embodiment in which each of the projections 11–32 are preferably filled with a suitable durable rubbery material enabling the use of a substantially spherical-shaped inner rubber bladder N which generally conforms to the spherical casing M. The ball shown in FIG. 4 will be heavier and have different rebounding qualities than the ball shown in FIG. 3. If desired, the material filling each of the hollow projections M may be lighter in weight than the surfaces of the projection and may, for example, be a rubber or a rubber-like foam material. All of the ball structures described retain the desirable ergonomic and erratic quality although the structure of the game ball shown in FIG. 4 would be slightly more erratic.

Figure 5:
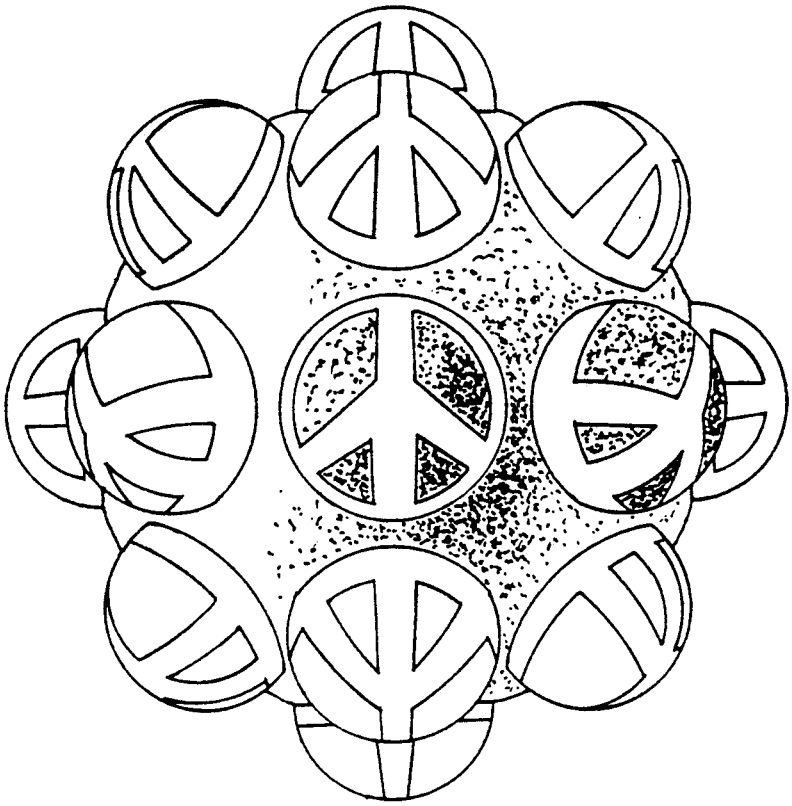
FIG. 5 shows an equatorial perspective view of the game ball of FIG. 1 and showing the preferred graphics provided thereon.

The ball may be provided with exterior adornment including a design element to enhance the aesthetic appearance and the appeal and marketability of the product. In one preferred embodiment shown in FIG. 5, the surface of the ball may preferably be black or another suitable dark color having a neon colored "PEACE" symbol arranged on each projection. The graphic pattern is preferably of a color which provides a sharp contrast to the background color of the ball and may, for example, be a bright color such as a neon yellow color. However, any other suitable color and/or color combination may be utilized depending upon the preferences of the user.

Figure 6:
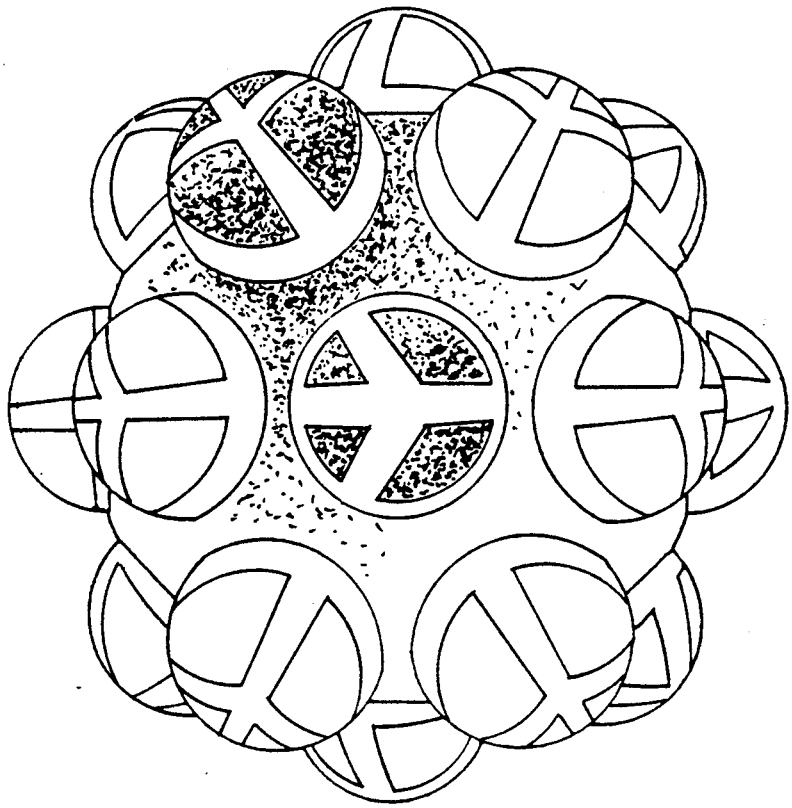
FIG. 6 is a different perspective view of the game ball of FIG. 1 also showing the graphic patterns thereon.

The exterior graphics add further uniqueness to the ball and provide the game ball with a pleasing appearance. In addition, the "PEACE" symbol shown in FIGS. 5 and 6 directly relates the ball to the playing surface.

Figure 7:
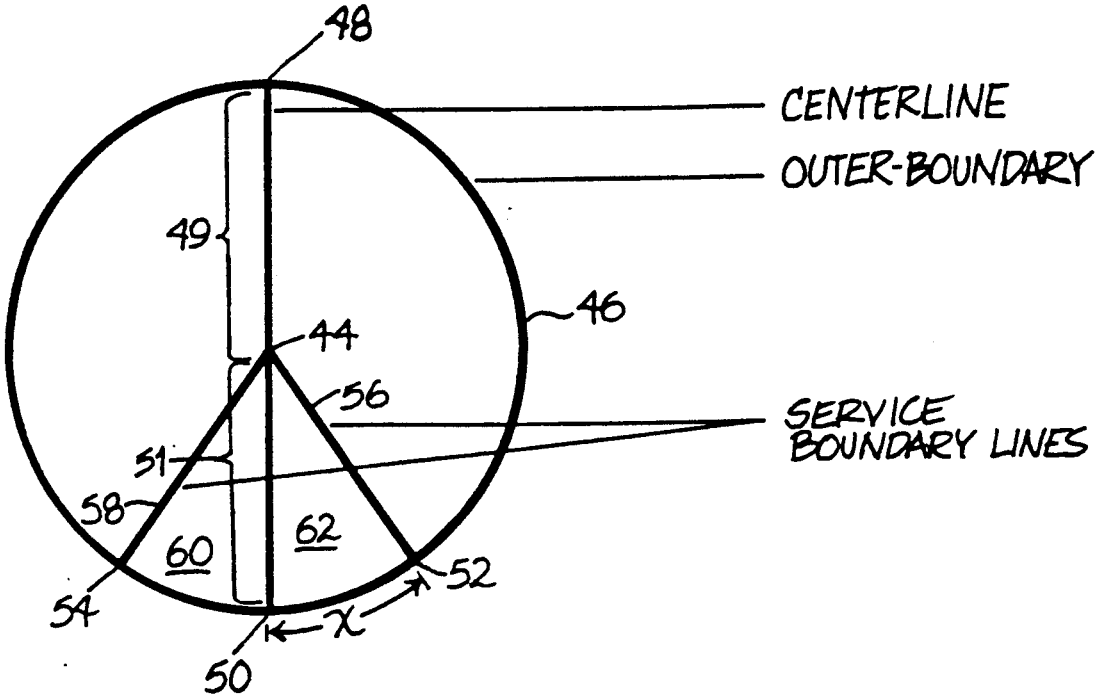
FIG. 7 is a top plan view of the playing court.
Figure 7A:
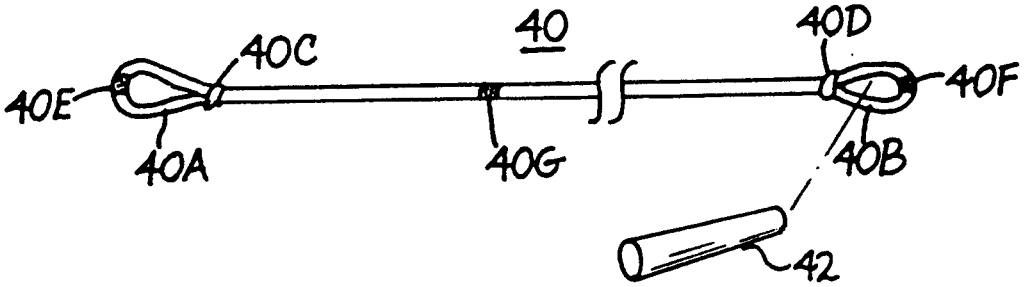
FIG. 7*a* shows the implements utilized to simply and rapidly create the playing court upon a suitable playing surface.

FIG. 7 shows a plan view of a completed playing surface which is laid out simply and rapidly through the use of a lightweight string or cord 40 shown in FIG. *7a*. Cord 40 is preferably provided with loops 40*a*, 40*b* at each end, which loops are maintained by knots 40*c*, 40*d*. The center of each loop is provided with a colored marking 40*e*, 40*f*. The loops are sufficiently large to accommodate a marking implement such as a piece of chalk 42 or other suitable marking instrument such as a crayon, marking pen, or the like. In the event that the playing court is to be formed upon a scorable playing surface such as a sandy beach, the marking instrument may be a wooden stick or stake, for example. The playing court is created by placing a mark with the marking instrument 42 defining the center 44 of the playing court, as shown in FIG. 7. One player, for example, by placing his finger through loop 40*a*, then holds one of the colored markers 40*e*, directly over or upon the center point 44 while a second player, placing the marking instrument 42 inside of loop 40*b* and in alignment with colored marker 40*f*, walks about center point 44 to draw a line representing the outer perimeter 46 of the playing court.

Placing the colored marker 40*e* over central point 44 and placing the other colored marker at a point such as, for example, point 48 on perimeter 46, the line is held taut and the marking instrument 42 is utilized to draw a radial line 49 using the tautly held cord 40 as a guide. The cord is then aligned between central point 44 and point 50 to draw a second radial line 51 which is co-linear with radial line 49 to collectively form a diameter line which serves as the centerline for the playing court. A third colored marking 40*g* is provided along the length of rope 40 a spaced distance from colored marker 40*e*. Placing marker 40*e* at point 50, the rope 40 is pulled taut and a point 52 is located which is determined by the intersection of colored marker 40*g* and perimeter 46. In a similar fashion, point 54 is located on perimeter 46. The rope 40 is then pulled taut and held between points 44 and 52 to act as a guide in drawing a radial line 56. A radial line 58 is drawn in a similar fashion, completing the layout of the playing court which can be seen to have a circular perimeter comprised of a centerline defined by radial lines 49 and 51. Two service areas are arranged on opposite sides of the centerline. Service area 60 is defined by lines 51, 58 and the portion of perimeter 46 extending between points 50 and 54. Similarly, service area 62 is defined by radial lines 51 and 56 and the portion of perimeter 46 extending between points 50 and 52. Perimeter 46 serves as the "out of bounds" line for the court. The game is started by a player from one team assigned, for example, to the half of the playing surface lying to the right of the centerline hitting the ball from a point outside the perimeter 46 into the service area 60 assigned to the opposing team. The ball must land within the playing surface 60 in order to be a valid serve. After the serve is made and the ball properly strikes the service area 60 of the team receiving the serve, the entire surface area within the perimeter 46 is utilized for the play of each point with the proviso that each team must return the ball hit into its half of the playing court over the centerline (49, 51) into the half of the playing court assigned to the opposing team, players being free to enter into their half of the playing court so long as they do not cross the centerline. A point is won by failure to properly return a ball before it has bounced the second time and/or failure to return the ball within the half of the overall playing region assigned to the opposing team.

The level of excitement and skill is elevated significantly due to the cumulative effect of the uncertainty of where the ball will be returned by the opposing team as well as the uncertainty of the angle of rebound of the ball from the playing surface.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A ball comprising:

a first substantially spherical member formed of a suitable resilient, rubber-like material;

said spherical member having a plurality of integral hemispherical-shaped projections arranged at predetermined positions about the surface of said spherical-shaped member;

said projections having a cumulative volume which is substantially equal to one-half the volume of the spherical member.

2. The ball of claim 1 wherein said spherical member is provided with a total of twenty-two projections.

3. The ball of claim 1 wherein all of said projections are the same radius.

4. The ball of claim 3 wherein the radius of the spherical member is of the order of 2.8 times greater than the radii of the projections.

5. The ball of claim 1 wherein said projections are arranged upon the surface of the spherical member such that certain of the projections are surrounded by a greater number of adjacent projections than other projections.

6. The ball of claim 5 wherein some of the projections are surrounded by six adjacent projections and other projections are surrounded by eight adjacent projections.

7. The ball of claim 1 wherein the spacing between a projection and some of the adjacent projections is different from the spacing between the first-mentioned projection and the remaining ones of the adjacent projections.

8. The ball of claim 5 being provided with twenty-two projections.

9. The ball of claim 8 wherein eight of said projections are arranged about an equatorial circle along the surface of said spherical member at equispaced intervals;

a second group of six projections being arranged about a first circle parallel to said equatorial circle and a spaced distance therefrom, said second group of projections being arranged at equispaced intervals along the first circle;

a third group of six projections being arranged at equispaced intervals about a second circle parallel to said equatorial circle and a spaced distance therefrom which is the same distance from the equatorial circle as the first circle and lying on the opposite side of said equatorial line; and the remaining two projections being arranged on the periphery of said spherical member and having their centers coaxial with a diameter passing through said spherical member and perpendicular to said equatorial circle.

10. The ball of claim 1 wherein each of the projections is provided with a graphic pattern.

11. The ball of claim 10 wherein said graphic pattern is a "PEACE" symbol.

12. A kit for playing a game comprising:

a game ball and a cord of a predetermined length having first, second and third colored markers;

said first and second colored markers being arranged near the ends of said cord; and said third colored marker being arranged intermediate said first and second colored markers;

said first and second colored markers being utilized to create a circle having a radius determined by the distance between said first and second colored markers, said circle being created by establishing a center point; holding the first colored marker over the center point; and pulling the cord taut and creating a circle with a marking implement held against the second marker as cord is tautly held and moved about the center marker;

said third colored marker being utilized with one of said first and second colored markers to mark points at equispaced distances from the intersection of said circle with a diameter of said circle, said diameter and two radial lines connecting the first and second points along said circle with said center marker being drawn by a marking instrument employing the cord as a guide;

said ball comprising:

a first substantially spherical member formed of a suitable resilient, rubber-like material;

said spherical member having a plurality of integral hemispherical-shaped projections arranged at predetermined positions about the surface of said spherical-shaped member;

said projections having a cumulative volume which is substantially equal to one-half the volume of the spherical member.

13. The apparatus of claim 12 wherein at least selected ones of said projections are provided with a "PEACE" symbol which resembles the playing court created by said cord.

14. The ball of claim 1 wherein said spherical-shaped member is hollow and is provided with a valve for filling said spherical-shaped member.

15. The ball of claim 14 wherein said valve is arranged upon the surface of said spherical-shaped member and at a position which does not effect the rebounding characteristics of the ball.

16. The ball of claim 1 wherein said spherical-shaped member is hollow and said projections are hollow and communicate with the hollow interior of the spherical-shaped member.

17. The ball of claim 1 wherein said spherical-shaped member is hollow and said projections are formed of a material of a substantially constant density throughout.

18. The apparatus of claim 17 wherein said material is a foam-like resilient material.

19. The ball of claim 14 further comprising:

an inflatable bladder arranged with said spherical member.

20. The ball of claim 19 further comprising a valve arranged along the surface of said spherical member and communicating with the inflatable bladder for inflation thereof.

* * * * *